US006650062B2

(12) United States Patent
Inoue et al.

(10) Patent No.: US 6,650,062 B2
(45) Date of Patent: Nov. 18, 2003

(54) PLASMA DISPLAY PANEL AND METHOD FOR MANUFACTURING THE SAME

(75) Inventors: Kazunori Inoue, Kawasaki (JP); Saburou Morita, Kawasaki (JP); Osamu Toyoda, Kawasaki (JP); Motonari Kifune, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/082,165

(22) Filed: Feb. 26, 2002

(65) Prior Publication Data

US 2003/0080683 A1 May 1, 2003

(30) Foreign Application Priority Data

Oct. 30, 2001 (JP) ..... 2001-333058

(51) Int. Cl.[7] ..... G09G 3/10; H01J 14/49
(52) U.S. Cl. ..... 315/169.3; 313/586
(58) Field of Search ..... 315/169.1, 169.2, 315/169.3, 169.4; 313/581, 582, 583, 584, 585, 586

(56) References Cited

U.S. PATENT DOCUMENTS 6,411,043 B1 * 6/2002 Jeong et al. ..... 315/169.3
6,433,489 B1 * 8/2002 Tanaka et al. ..... 315/169.4
6,501,221 B1 * 12/2002 Kim et al. ..... 313/583
6,522,071 B1 * 2/2003 Park et al. ..... 313/582
6,525,470 B1 * 2/2003 Amemiya ..... 313/586

* cited by examiner

*Primary Examiner*—Don Wong
*Assistant Examiner*—Minh D. A
(74) *Attorney, Agent, or Firm*—Staas & Halsey LLP

(57) ABSTRACT

A PDP having a novel cell structure that is superior in light emission efficiency is provided. A conductive film to be display electrodes X and Y is formed on side portions of a wall so that a main surface that contributes to discharge in the display electrode X is disposed so as to be opposed to a main surface of the neighboring display electrode Y via a gas space. A power supplying portion straddling plural cells in the display electrodes X and Y is provided on the upper surface of the wall. The display electrodes X and Y are covered with a dielectric layer that is thin at the side portion and thick at the top portion of the wall.

6 Claims, 4 Drawing Sheets

PLASMA DISPLAY PANEL AND METHOD FOR MANUFACTURING THE SAME

BACKGROUND OF THE INVENTION

1. Field of the Invention

The present invention relates to a plasma display panel (PDP) and a method for manufacturing the same.

A PDP has received attention as a slim display device having a wide viewing angle. As being used widely as a HDTV, a high performance PDP with higher luminance is desired.

2. Description of the Prior Art

An AC type PDP that is commercialized as a large screen display device for a television set is a surface discharge type. The surface discharge type means a type of structure in which first and second display electrodes to be anodes and cathodes in display discharge, i.e., main discharge for ensuring a certain luminance are arranged in parallel on the front or back substrate. In the surface discharge type, a fluorescent material layer for a color display can be disposed away from a display electrode pair in the direction of the panel thickness so that deterioration of the fluorescent material layer due to an impact of ions in the discharge can be reduced, thereby a long life color screen can be realized.

An electrode matrix structure of the surface discharge type is typically a "three-electrode structure" in which address electrodes for selecting cells are arranged so as to cross the display electrodes. In a basic form of the three-electrode structure, a pair of display electrodes is arranged for each row of a screen. An arrangement space (a surface discharge gap length) of a display electrode pair in each row is set to a few tens of microns so that discharge can be generated in response to application of a voltage at approximately 150–200 volts. In contrast, an electrode gap between neighboring rows (called a reverse slit) is set to a value sufficiently (a few times) larger than the surface discharge gap length for preventing an undesired surface discharge between rows and for reducing a capacitance. Namely, the arrangement space between the display electrodes in a row is different from the arrangement space between the display electrodes of neighboring rows. In this basic form, the inverted slit does not contribute to light emission, so a usage ratio of the screen is small. This means a disadvantage in luminance and a difficulty in high definition by reducing the row pitch.

As another form of the three-electrode structure, there is an electrode structure in which N+1 display electrodes (N is the number of rows of a screen) are arranged at a constant pitch, and surface discharge is generated between neighboring electrodes making an electrode pair. In this way, the usage ratio of the screen can be enhanced. However, since each display electrode except both ends of the arrangement works for two rows, a driving sequence for addressing for setting display contents becomes more complicated than the basic form.

In the conventional PDP, the display electrode is formed by patterning a conductive thin film formed on the substrate. Namely, the surface of the display electrode is substantially parallel with the surface of the substrate. Furthermore, in the cell structure (called a reflection type) in which the fluorescent material layer is disposed at the back side of the discharge gas space, the display electrode is a lamination including a wide band-like transparent conductive film and a narrow band-like metal film for compensating the conductivity of the transparent conductive film, so as to reduce the light shield by the electrode.

Conventionally, the surface discharge gap length is shorter than one fourth of the column direction size of a cell, and a positive column that provides high luminance rarely appears in the surface discharge. Therefore, there is a problem that the light emission efficiency is low. There is another problem that wasteful power consumed in charging a capacitance between the display electrodes is large. Since the power consumption is apt to increase as a high definition is progressed, it is important to reduce the power consumption also for heat control. In addition, since the display electrode includes the transparent conductive film and the metal film in a reflection type, there are problems of increase of the number of manufacture process due to usage of the different materials and increase of possibility of occurrence of an exfoliation at an interface between the films.

SUMMARY OF THE INVENTION

An object of the present invention is to provide a PDP having a novel cell structure that is superior in light emission efficiency. Another object is to provide a method for manufacturing a PDP having a novel cell structure with high productivity.

The present invention provides a plasma display panel in which a conductive film to be display electrodes is formed on the side portions of the wall, so that a main surface that contributes to discharge in the display electrode is substantially perpendicular to surface of the substrate and is opposed to another main surface of the neighboring display electrode via a gas space. A power supplying portion straddling plural cells in the display electrode is disposed on the upper surface of the wall. Namely, the display electrode (the conductive film) has a shape straddling the top portion and the side portions of the wall. In addition, to suppress discharge between the power supplying portions of the neighboring display electrode and to make discharge between the main surfaces generate easily, the display electrode is covered with a dielectric layer that is thin at the side portions and is thick at the top portion of the wall.

The discharge form is the opposed discharge between the electrodes that sandwich the gas space (however, the charge movement direction is not the panel thickness direction but is the direction along the surface of the substrate). This discharge form is called "surface direction opposed discharge". Since the distance between the display electrodes is large in the cell structure of the present invention, discharge with high luminance in which a positive column extends can be generated, and capacitance between display electrodes can be reduced substantially. In addition, by selecting the area and the shape of the main surface of the display electrode at the side portions of the wall, discharge current can be optimized and the light emission efficiency can be improved.

The dielectric layer is formed by the thick film method, and plural types of pastes having different flowability are used so as to obtain a layer that is thick partially. Glass paste having low flowability by adding filler is applied to the portion to be thick (the top portion of the wall), and glass paste having high flowability is applied to the entire wall including the portion to be thick for forming the thin portion.

DESCRIPTION OF THE PREFERRED EMBODIMENTS

Hereinafter, the present invention will be explained more in detail with reference to embodiments and drawings.

Figure 1:
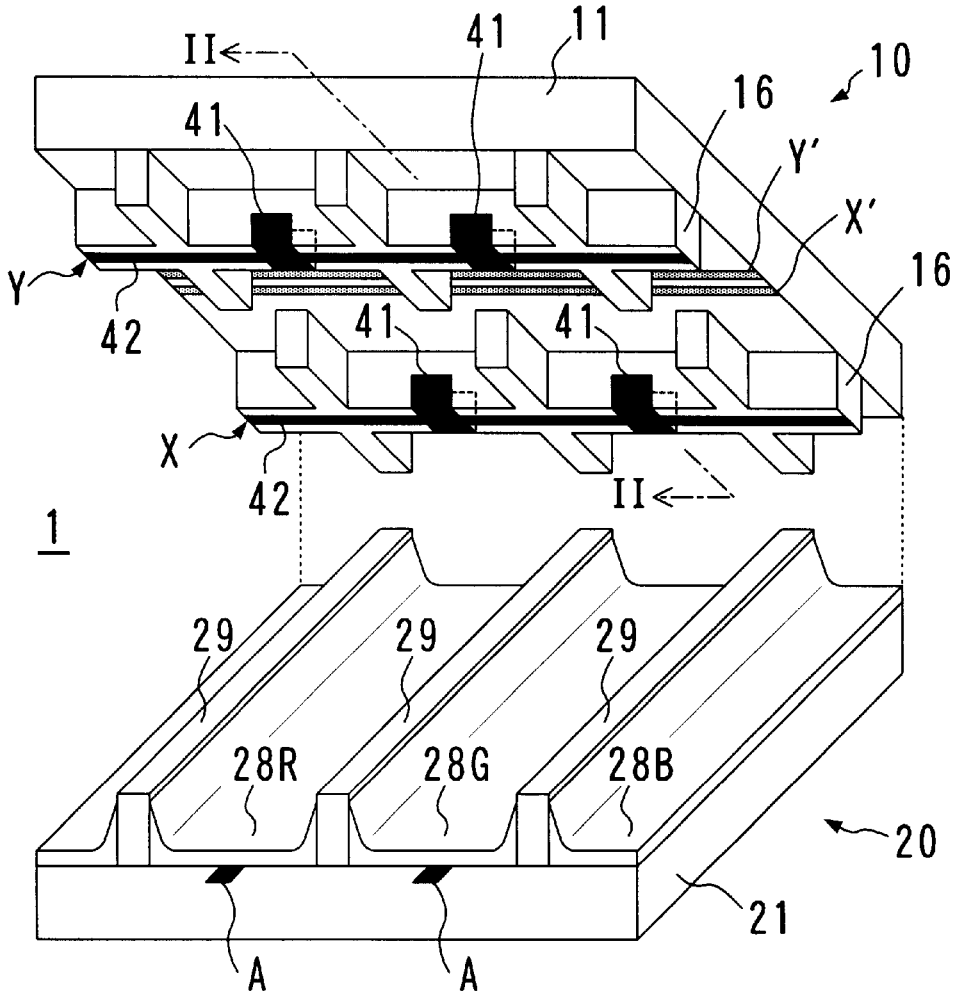
FIG. 1 is a schematic diagram showing a 3-D electrode structure in a PDP according to the present invention.

FIG. 1 is a schematic diagram showing a 3-D electrode structure in a PDP according to the present invention. For easy understanding of the structure, a dielectric layer covering the electrode is not drawn in FIG. 1.

The illustrated PDP 1 is a color display device in which multiple cells are arranged so as to form rows and columns of a matrix display and includes a pair of substrate structures 10 and 20. The substrate structures 10 and 20 include substrates 11 and 21, respectively, together making a so-called enclosure and cell structure elements formed on the inner surface of the substrate 11 or 21. FIG. 1 shows a structure of two columns of one row in a display screen, i.e., two cells and the adjacent surface.

The structure of the back substrate structure 20 is similar to the structure of a known typical surface discharge type PDP. Address electrodes A are arranged on the inner surface of the back glass substrate 21 so that one address electrode A corresponds to one column, and partitions 29 having a linear band-like shape in a plan view are formed so that one partition 29 is disposed at each boundary between columns. The area between the partitions and the side surfaces of the partition 29 are covered with fluorescent material layers 28R, 28G and 28B for a color display. The color arrangement is a repeating pattern of red, green and blue colors in which cells of each column have the same color. One pixel of a display image corresponds to three columns (three cells). It is possible to adopt a structure in which the address electrode A is covered with a dielectric layer.

The front substrate structure 10 has a structure unique to the present invention. Partitions 16 are arranged on the inner surface of the front glass substrate 11 so that one partition 16 is disposed at each boundary between rows as a boundary wall. Each of the partitions 16 includes a horizontal portion that is continuous over the entire length of the row and crosses the back partition 29 in a plan view and a vertical portion protruding from both sides of the horizontal portion. The vertical portion overlaps the partition 29 in a plan view. A set of partitions 16 corresponds to a structure of a grid surrounding cells and being cut off at middle portions of each row. By cutting off the grid structure, ventilation is obtained that is suitable for filling the discharge gas and for exhausting air in the preprocess. The partition 16 is formed preferably by a sandblasting method. On the entire surface of the display screen, glass paste is printed uniformly and is dried. Then, a photosensitive dry film is used for making a mask, through which unnecessary portions in the paste layer are cut off. The patterned paste layer is baked so that the partition 16 is obtained. The partition 16 can be also formed by a method of shaving the surface of the glass substrate 11 or by a screen printing method.

The plural partitions 16 separated from each other shown in FIG. 1 indicate protrusions on the substrate surface schematically. It is possible to provide another structure in which plural partitions 16 are unified. For example, when the partitions 16 are formed by the sandblasting method as explained above, if the trimming is finished before the glass substrate 11 is exposed sufficiently, the partition having plural protruding portions whose lower edges are linked with each other is obtained. In addition, if the surface of the glass substrate 11 is shaved for forming pits and projections, the partition 16 is a part of the glass substrate 11.

This partition 16 comprises walls defining both ends of each cell and enables an electrode arrangement for "opposed discharge along the surface direction". In the structure shown in FIG. 1, a part of one partition 16 (a horizontal surface) defines a wall at one end. In addition, neighboring partitions 16 define both (i.e., opposite) ends of a cell in one row. In the PDP 1, a display electrode X is formed on one of the neighboring partitions 16, and a display electrode Y is formed on the other. The arrangement form of the display electrodes X and Y in the entire screen is a form in which the display electrodes X and Y are arranged alternately at a constant pitch at a rate of three per two rows, and the neighboring electrodes make an electrode pair. The total number of the display electrodes is the number of rows plus one.

The display electrode X is a patterned conductive film including a discharge surface 41 provided for each column and a power supplying surface 42 for linking the discharge surfaces 41 of one row. The power supplying surface 42 is located on the top surface of the partition 16, and the discharge surface 41 protrudes at the middle position of the column from both sides of the power supplying surface 42 so as to straddle the top surface and the side surfaces of the partition 16. The display electrode Y also includes the discharge surface 41 for each column and a power supplying surface 42 for linking the discharge surfaces 41. The structure of the display electrode Y is identical to that of the display electrode X. A metal is suitable for the material of the power supplying surface 42 for the necessity of reducing a line resistance. A three-layered film of Cr—Cu—Cr is a typical material of the power supplying surface 42. It is desirable to form the discharge surface 41 together with the power supplying surface 42 for reducing the number of manufacture process and for improving yields. However, the discharge surface 41 can be made of a transparent conductive material such as ITO or Nesa. A pair of auxiliary electrodes X' and Y' are arranged between the display electrode X and the display electrode Y, i.e., at the middle position of the row.

Figure 2:
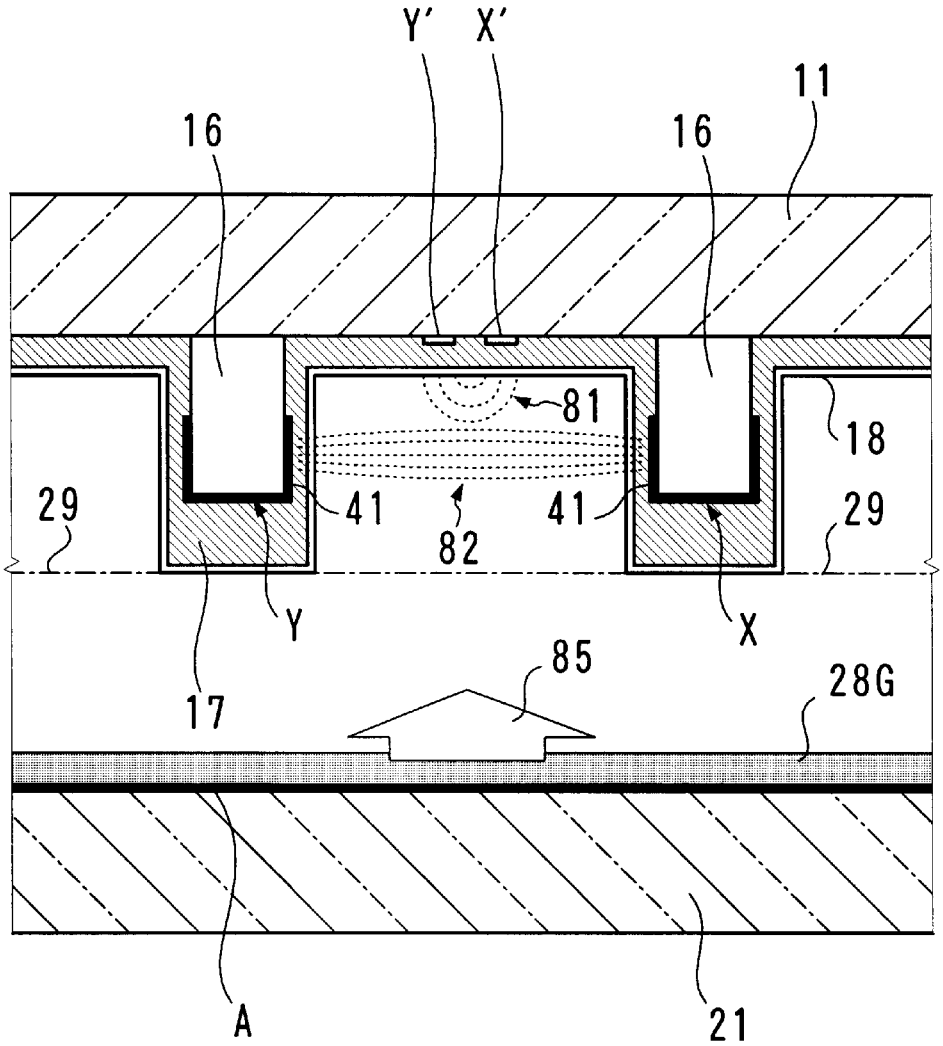
FIG. 2 is a schematic diagram of a cell structure of a PDP according to the present invention.

FIG. 2 is a schematic diagram of a cell structure of a PDP according to the present invention, which shows a cross section taken along the II—II line in FIG. 1.

As shown in FIG. 2, the display electrodes X and Y are actually covered with a dielectric layer 17 and a sputtering resistant protection film 18 extending over the entire partition 16. The material of the protection film 18 is magnesia. It is important for the dielectric layer 17 that the thickness of the layer is not uniform, but is thin at the side surfaces of the partition 16 and thick at the top surface. By setting the thickness of the dielectric layer 17 in this way, discharge can be generated most easily between the opposed surfaces (called main surfaces) of the discharge surfaces 41 when a voltage is applied to the neighboring display electrodes X and Y. Namely, though the discharge surface 41 covers also the top surface of the partition 16, discharge between the top surfaces of the partitions 16 or between the top surface and the side surface is suppressed. It is difficult to define the top surface and the side surface exactly. As a concept, the surface whose surface is substantially parallel to the surface of the substrate is the top surface, and the surface whose surface is substantially perpendicular to the surface of the substrate is the side surface. When the partition 16 is formed by the sandblasting method, the top surface becomes substantially flat.

Discharge 82 between the main surface of the display electrode X and the main surface of the display electrode Y is opposed discharge in the surface direction. Since the distance between these main surfaces has a value close to the cell size in the column direction, i.e., a sufficiently large value after subtracting the width of the partition 16, the discharge 82 becomes discharge with a positive column of high luminance. In addition, since the capacitance between the electrodes is small, wasteful power for charging the capacitance is little, which contributes to improvement of the light emission efficiency. As is clear from FIG. 2, since the discharge 82 is generated at a position separated from the fluorescent material layer (the fluorescent material layer 28G in FIG. 2), the fluorescent material is hardly deteriorated in the PDP 1 similarly to the conventional surface discharge type PDP.

A general driving sequence for display using the PDP 1 having the above-explained structure is as follows. Since each of the display electrodes X and Y, except for both (i.e., opposite) ends of the arrangement is common to two neighboring rows in the electrode structure of the PDP 1, an interlace drive is performed in which one frame is divided into a field for displaying data of odd rows and a field for displaying data of even rows. In the address period of each field, the auxiliary electrode Y' is used as a scan electrode for performing a row selection, and simultaneously the address electrode A corresponding to the cells to be lighted in the selected row is biased to a selecting potential. Thus, address discharge is generated between the auxiliary electrode Y' and the address electrode A of the cell to be lighted. The similar process is performed for every row sequentially, so that predetermined quantity of wall charge is formed in the cell to be lighted. In the display period after the address period, a sustaining voltage is applied between the auxiliary electrode X' and the auxiliary electrode Y' of every row to be the target of the display, thereby surface discharge 81 is generated only in the cells to be lighted having wall charge. Thus, being triggered by the surface discharge 81, the opposed discharge (the discharge 82) in the surface direction is generated only in the cells to be lighted by applying the sustaining voltage between the display electrode X and the display electrode Y. When receiving energy of the opposed discharge in the surface direction, the discharge gas emits ultraviolet rays. The ultraviolet rays excite the fluorescent material layer 28G, which emits display light 85. Even if the auxiliary electrode X' is omitted, the display is possible. In this case, the surface discharge 81 is not generated, but the wall charge formed in the address period is utilized for generating the discharge 82. In addition, it is possible to enhance the light emission luminance by forming the fluorescent material layer also in the area surrounded by the partitions 16 on the front glass substrate 11, preferably on the surface of the protection film avoiding the display electrodes X and Y.

A process for manufacturing the PDP 1 includes a step of arranging the above-mentioned structure elements on each of the glass substrates 11 and 21 individually so as to obtain the substrate structures 10 and 20, a step of sealing the periphery of the substrate structures 10 and 20 after placing them so as to be opposed to each other, and a step of filling discharge gas inside the structures 10 and 20 after cleaning the same. Hereinafter, formation of the dielectric layer 17 unique to the present invention in manufacturing process of the substrate structure 10 will be explained.

Figure 3A:
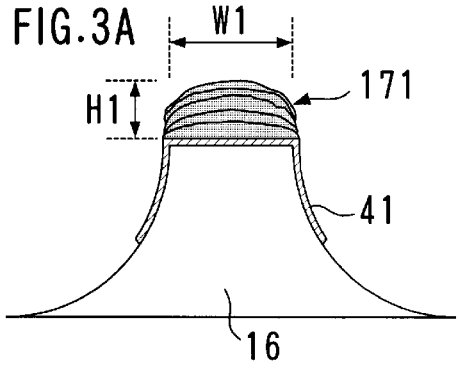
FIGS. 3A–3E are explanatory diagrams of a process for forming the dielectric layer.
Figure 4:
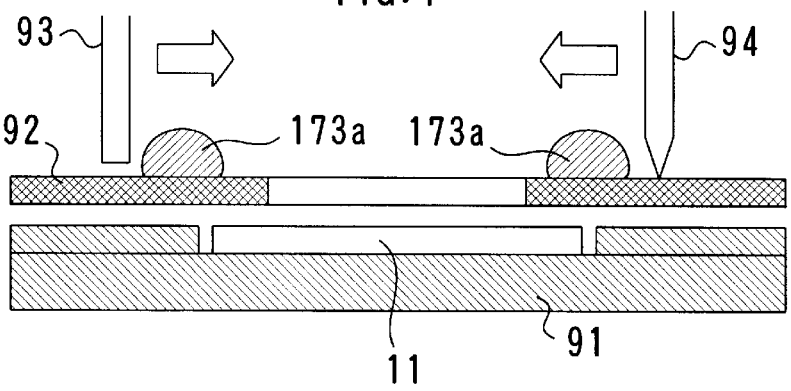
FIG. 4 is a diagram for explaining a printing method.
Figure 5:
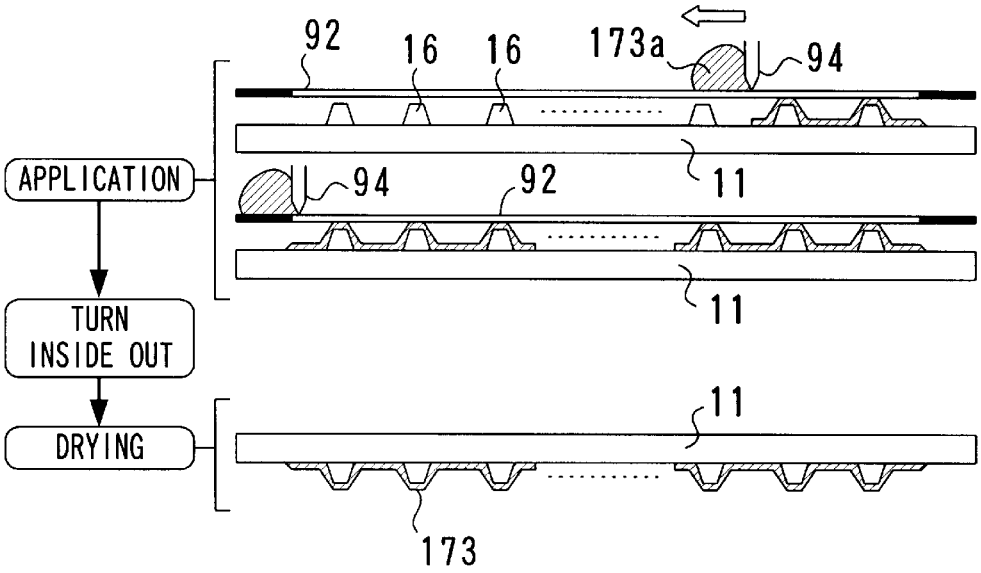
FIG. 5 is a diagram for explaining a process for printing the entire surface.

FIGS. 3A–3E are explanatory diagrams of a process for forming the dielectric layer. FIG. 4 is a diagram for explaining a printing method. FIG. 5 is a diagram for explaining a process for printing the entire surface.

The dielectric layer is formed by the thick film method, in which glass paste is printed by screen printing and is baked. The formation process is roughly divided into five steps.

In the first step, paste (a first glass paste according to the present invention) containing glass beads as filler for preventing flow is printed on the top portion of the partition 16. As shown in FIG. 3A, it is printed accurately so as to extend over the entire top portion width W1 but not to be off the same. If the printed area does not reach the both ends of the top portion or is shifted from the top portion, it becomes a defective. In order to print accurately, the following parameters are adjusted for optimizing the print condition.

(1) An aperture size of the stencil (a mask)

(2) A squeegee speed (3) A pressure of printing (hereinafter, referred to as a printing pressure)

(4) Diluent quantity of organic solution for the glass paste

After printing the paste, drying process is performed in nitrogen atmosphere at 130° C. for 20 minutes. The smaller the film thickness H1 of the dried paste 171 is, the thinner the portion of the dielectric layer 17 that covers the side portions of the partition becomes and a discharge start voltage decreases. However, even if it is desired to make the dielectric layer of the partition side portion thinner, the film thickness H1 is preferably more than 80 microns. If this condition is not satisfied, the defect is apt to be generated easily that the paste does not stick to the corner at the boundary between the top portion and the side portion in the next step. In order to eliminate a dielectric breakdown, it is necessary to cover the corner of the partition 16 with a sufficiently thick dielectric layer. In a concrete example, if it is desired to set the thickness of the dielectric layer at the side portion of the partition to 50 microns, the film thickness H1 is set to 130 microns. As glass paste used in the first step, there is a mixture of low melting point glass powder as the main ingredient and a vehicle to which hollow glass beads (HSC-110B) made by Toshiba Ballotini Kabushikigaisha (current Potters Ballotini Ltd.) are added at the ratio of 30 weight percent.

Figure 3B:
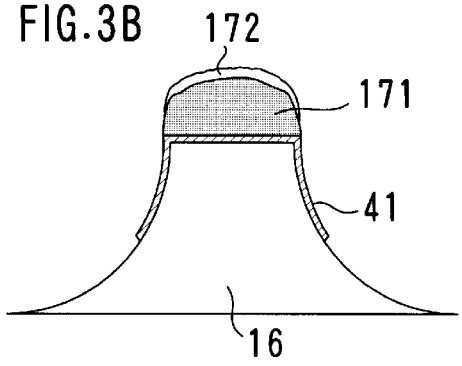

In the second step, to prevent the beads from flowing out of the paste 171 printed in the first step when printing in the next third step, a paste layer 172 that is similar to the glass paste in the third step and contains more filler is formed on the top portion of the partition 16 (see FIG. 3B). The paste is printed with accurate registration in the same way as in the first step. The film thickness is adjusted to be 30 microns after the drying process at 130° C. for 20 minutes. As the glass paste used in the second step, there is a mixture of low melting point glass powder and a vehicle to which grains of silicon dioxide having the diameter of 5 microns are added at the ratio of 75 weight percent.

In the third step, to form the dielectric layer covering the side portions of the partition, glass paste (a second glass paste according to the present invention) is printed on the entire wall 16 including the dried paste layers 171 and 172. As shown in FIGS. 4 and 5, a glass substrate 11 is placed on a table 91, and a stencil 92 is placed on the glass substrate 11. Then, a scraper 93 is a little away from the stencil 92 for coating a paste 173*a* on the stencil 92 without contacting the partition 16 of the glass substrate 11. After that, the coated paste 173*a* is printed on the glass substrate 11 by using the squeegee. The process in which the coating step is omitted can be adopted. The drying step after printing is performed at 110° C. for 50 minutes after turning the glass substrate 11 inside out so that the partition 16 is directed downward and the glass substrate 11 is retained horizontally. Thus, the paste

Figure 3C:
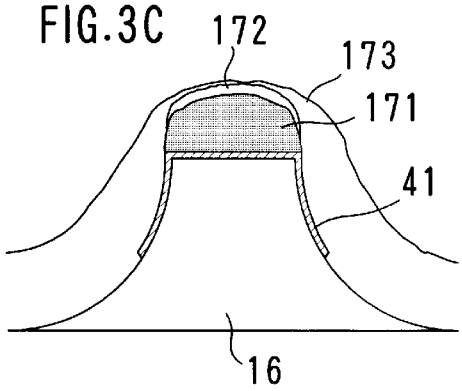
Figure 3D:
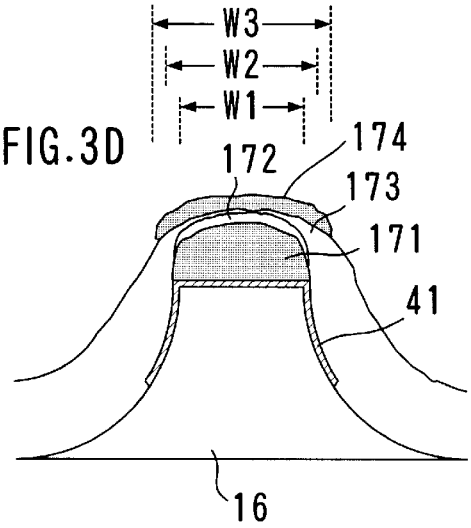
Figure 3E:
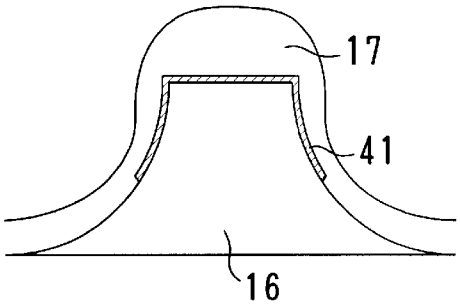

173*a* is prevented from flowing and dropping at the bottom surface side of the partition 16, so that the corner of the partition 16 can be coated sufficiently. The shape of the paste 173 after the drying step is as shown in FIG. 3C. In this case, it is important that the paste 173 has a predetermined thickness at both sides of the paste 171 of the first step. If a pressure of printing is too high, the thickness of the paste 173 is insufficient, and the above-mentioned corner of the partition 16 is not coated sufficiently as a result. As glass paste used in the third step, there is a mixture of low melting point glass powder and a vehicle to which grains of silicon dioxide having the diameter of 5 microns are added at the ratio of 15 weight percent and an organic solvent are added for dilution. The quantity of the organic solvent is determined appropriately in accordance with the printed film thickness (generally within the range of 60–100 ml/kg).

In the fourth step, to make the coated state of the corner of the partition 16 better, glass paste (a third glass paste according to the present invention) that has lower flowability on baking than the paste of the third step is printed on the dried glass paste 173 so as to protrude from the top portion to such an extent that the top portion of the wall 16 is covered but most of the side portion is not covered, and then the third glass paste is dried. In the printing, a stencil is used that has a mask aperture width W2 larger than the top portion width W1 of the partition 16 by approximately 40 microns at both ends. Thus, the print can be performed on the area having the width W3 larger than the width W1 by approximately 60 microns at both ends though there is some variation depending on the dilution quantity of the paste. The film thickness of the glass paste 174 after the drying process at 130° C. for 20 minutes becomes 20 microns (see FIG. 3D). As the glass paste used in the fourth step, there is a mixture of low melting point glass powder and a vehicle to which the same glass beads as in the first step are added at the ratio of 30 weight percent.

In the fifth step, baking is performed at 590° C. for 40 minutes. The paste 173 printed overall in the third step flows to the bottom side of the partition 16 in the baking step. In contrast, since the paste 174 printed partially in the fourth step has lower flowability than the paste 173, a retaining force is generated at the interface between the paste 173 and the paste 174, so that the coated film at the corner and the side portion of the partition 16 has sufficient thickness. Since the paste having low flowability in the first step, the coated film of the partition 16 has substantially larger thickness at the top portion than at the side portion (see FIG. 3E).

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A plasma display panel, comprising:

a pair of substrates opposed to each other and constituting an enclosure;

wall portions disposed at respective boundaries between corresponding neighboring discharge cells and extending in a direction narrowing a gap between the opposed substrates, locally, each discharge cell having opposed side surfaces of wall portions at opposite ends thereof;

a conductive film formed on the wall portions so as to straddle a top surface and spaced side surfaces of the wall portions; and a dielectric layer covering the conductive film, wherein the dielectric layer is thicker in a portion thereof covering the top surface than in a portion thereof covering the side surfaces, so that a discharge is generated more easily between the opposed side surfaces than between other surfaces thereof when a voltage is applied between conductive films of the opposed side surfaces of respective discharge cells.

2. A method for manufacturing a plasma display panel that includes a pair of substrates opposed to each other and constituting an enclosure, wall portions disposed at respective boundaries between corresponding neighboring discharge cells and extending in a direction narrowing a gap between the opposed substrates, locally, each discharge cell having opposed side surfaces of wall portions at opposite ends thereof; a conductive film formed on the wall portions so as to straddle over the top surface and the side surfaces of the wall and a dielectric layer covering the conductive film, wherein the dielectric layer is thicker in a portion thereof covering the top surface than in a portion thereof covering the side surfaces, so that a discharge is generated more easily between the opposed side surfaces than between other surfaces thereof when a voltage is applied between the conductive films of the opposed side surfaces of respective discharge cells, the method comprising:

applying a first glass paste containing filler restricting flow of the paste only to the top surface of the wall;

drying the first glass paste;

applying a second glass paste having more flowability on baking than the first glass paste to the entire wall, so as to cover the dried first glass paste;

drying the second glass paste; and baking the dried first glass paste and the second glass paste as a bulk for forming the dielectric layer.

3. A method as recited in claim 2, further comprising the step of forming a layer on the first glass paste after applying and drying the first glass paste and before applying the second glass paste, the layer being for preventing the filler from flowing out of the first glass paste into the second glass paste when applying the second glass paste.

4. A method as recited in claim 2, further comprising: applying a third glass paste on the dried second glass paste and drying the third glass paste after applying and drying the second glass paste, so as to protrude from the top surface to such an extent that the top surface of the wall is covered but most of the side surface of the wall is not covered, wherein the third glass paste has lower flowability on baking than the second glass paste, and the dried first, second and third glass paste is baked as a bulk.

5. A method as recited in claim 2, wherein the filler for restricting flow of the paste comprising hollow glass beads.

6. A method as recited in claim 2, wherein the second glass paste is dried in a state in which the substrate to which the second glass paste is applied is placed with the top surface being directed downwardly.

* * * * *

UNITED STATES PATENT AND TRADEMARK OFFICE

CERTIFICATE OF CORRECTION

PATENT NO. : 6,650,062 B2
DATED : November 18, 2003
INVENTOR(S) : Kazunori Inoue et al.

It is certified that error appears in the above-identified patent and that said Letters Patent is hereby corrected as shown below:

Column 8,
Line 10, after "between" insert -- the --.

Signed and Sealed this

Second Day of March, 2004

JON W. DUDAS
*Acting Director of the United States Patent and Trademark Office*